US006964403B2

(12) United States Patent
Fox

(10) Patent No.: US 6,964,403 B2
(45) Date of Patent: Nov. 15, 2005

(54) MINIATURE FLAG HOLDER

(76) Inventor: Steven Alfred Fox, 2373 Boxwell Rd., Prospect, OH (US) 43342

( * ) Notice: Subject to any disclaimer, the term of this patent is extended or adjusted under 35 U.S.C. 154(b) by 128 days.

(21) Appl. No.: 10/372,368

(22) Filed: Feb. 21, 2003

(65) Prior Publication Data

US 2003/0183739 A1 Oct. 2, 2003

Related U.S. Application Data

(60) Provisional application No. 60/367,836, filed on Mar. 28, 2002.

(51) Int. Cl.[7] ..... G09F 17/00

(52) U.S. Cl. ..... 248/537; 248/535; 248/538; 248/205.3; 116/173; D11/182

(58) Field of Search ..... 248/537, 205.2, 248/534, 535, 538, 205.3, 206.2

(56) References Cited

U.S. PATENT DOCUMENTS

| | | | | | |
|---|---|---|---|---|---|
| D19,587 | S | * | 1/1890 | Steltz | D8/363 |
| 466,960 | A | * | 1/1892 | Bert et al. | 248/538 |
| 981,603 | A | * | 1/1911 | Adelson | 248/538 |
| 1,053,255 | A | * | 2/1913 | Ward | 248/536 |
| 1,203,937 | A | * | 11/1916 | Surface | 248/513 |
| 1,597,266 | A | * | 8/1926 | Dearman | 248/514 |
| 1,632,726 | A | * | 6/1927 | Conklin | 248/538 |
| 1,648,220 | A | * | 11/1927 | Gerow et al. | 248/541 |
| 1,795,824 | A | * | 3/1931 | Bellavance | 211/69.7 |
| 2,794,414 | A | * | 6/1957 | Refschneider | 116/173 |
| 3,162,409 | A | * | 12/1964 | Straayer et al. | 248/514 |
| 3,321,068 | A | * | 5/1967 | Beach | 206/306 |
| 4,291,809 | A | * | 9/1981 | Lyon | 211/69.5 |
| D265,324 | S | * | 7/1982 | Hedgeman | D19/85 |
| D292,782 | S | * | 11/1987 | Restrepo | D11/182 |
| 5,090,649 | A | * | 2/1992 | Tipp | 248/176.2 |
| 5,105,574 | A | * | 4/1992 | Fast | 43/21.2 |
| 5,156,110 | A | * | 10/1992 | Fuller | 116/173 |
| D335,031 | S | * | 4/1993 | Resnik et al. | D3/221 |
| 5,232,103 | A | * | 8/1993 | Koenig et al. | 211/69.5 |
| 5,233,938 | A | * | 8/1993 | Lalo | 116/173 |
| D340,676 | S | * | 10/1993 | Gallagher | D11/182 |
| 5,253,608 | A | * | 10/1993 | Burke | 116/173 |
| 5,321,904 | A | * | 6/1994 | Benson | 43/21.2 |
| 5,377,944 | A | * | 1/1995 | Getsinger | 248/218.4 |
| 5,385,161 | A | * | 1/1995 | Loker et al. | 135/15.1 |
| 5,405,024 | A | * | 4/1995 | Sahf | 211/69.5 |
| 5,463,974 | A | * | 11/1995 | Seeder | 116/173 |
| 5,520,141 | A | * | 5/1996 | Lutz | 116/173 |
| 5,524,856 | A | * | 6/1996 | Neely et al. | 248/534 |
| 5,568,784 | A | * | 10/1996 | Willis et al. | 116/173 |
| RE35,731 | E | * | 2/1998 | Lach | 248/535 |
| 5,727,583 | A | * | 3/1998 | Kennedy | 135/20.1 |

(Continued)

FOREIGN PATENT DOCUMENTS

FR 351379 * 5/1905

*Primary Examiner*—Anita M. King

(57) ABSTRACT

The present invention is a one piece molded miniature flag holder used to display the smallest sized flags, banners or pennants on computers, cash registers, refrigerators, filing cabinets or walls and partitions for decorative purposes. The flag holder displays the flags, banners or pennants at a nearly vertical position, and can be attached to multiple surfaces with double-sided adhesive mounting tape, magnet strip tape, and/or Velcro™ hook and loop fastening system.

2 Claims, 6 Drawing Sheets

U.S. PATENT DOCUMENTS

D401,016 S * 11/1998 Holliday ..... D28/73
6,213,440 B1 * 4/2001 Kornback ..... 248/514
D448,717 S * 10/2001 Hanson et al. ..... D12/223
6,352,229 B1 * 3/2002 Adams ..... 248/316.7
D475,677 S * 6/2003 Zucker ..... D12/223
D476,919 S * 7/2003 Vidmar et al. ..... D11/182
6,742,757 B2 * 6/2004 Fox ..... 248/538
2003/0098404 A1 * 5/2003 Fox ..... 248/538

* cited by examiner

FRONT VIEW

TOP VIEW

SIDE VIEW

BOTTOM VIEW

BACK VIEW

MINIATURE FLAG HOLDER

CROSS-REFERENCE TO RELATED APPLICATIONS

This application claims the benefit of U.S. Provisional Patent Application Ser. No. 60/367,836 filed Mar. 28, 2002 and titled "Mini-clip" and incorporated herein by reference. Related applications include U.S. Provisional Patent Application Ser. No. 60/333,006, filed Nov. 26, 2001, titled "Post clip"; U.S. Provisional Patent Application Ser. No. 60/349, 284, filed Jan. 17, 2002, titled "Wall clip"; patent application Ser. No. 10,295,607 titled Post-wall flag holder, filed Nov. 15, 2002, and patent application Ser. No. 10,295,584 titled "rail fence flag holder", filed Nov. 15, 2002.

STATEMENT REGARDING FEDERALLY SPONSORED RESEARCH OR DEVELOPMENT

Not applicable

REFERENCE TO SEQUENCE LISTING, A TABLE, OR A COMPUTER PROGRAM LISTING COMPACT DISK APPENDIX

Not applicable

BACKGROUND OF THE INVENTION

The present invention relates generally to flag accessories, holders and brackets, and more particularly, to a one-piece molded plastic holder used to display the smallest size flags, banners or pennants on computer monitors, cash registers, bulletin boards, interior or exterior walls or smooth surfaces and fabric coated partitions. During festive times and national holidays, it is desirable to display flags of many sorts. There are many various patents for flag holding devices, but most are for the standard 3'×5' or 4'×6' flags. Holders designed to display the smallest 4 inch by 6 inch flags have focused on a pedestal base to stand them on a table or counter surface and not a means to attach them to a wall or other upright position.

Various patents have proposed different methods of displaying flags by attaching them to flat surfaces, by means of drilling holes into the surface and attaching with screws or other fasteners. U.S. Pat. No. Re. 35,731 to Lach, describes a flag pole bracket which must be attached to a flat surface by means of screws. U.S. Pat. No. 5,524,856 to Neely & Shriner describes a rail bracket flag holder, but this application merely provides a base to attach a conventional flag holder with bolts and wing nuts. Other previous patents for flag holders include U.S. Pat. No. 466,960 to Bert & Widmayer, U.S. Pat. No. 1,053,255 to Ward, U.S. Pat. No. 1,198,840 to Hanck & David, U.S. Pat. No. 1,632,726 to Conklin, and U.S. Pat. No. 2,914,278 to Burke. A flagpole assembly, U.S. Pat. No. 5,253,608 to Burke also requires a bracket to be attached with screws to the desired surface.

In addition, flag holder patents include U.S. Pat. No. 2,322,600 to Stahler which requires the pointed end of the holder to be pushed into the ground for display and U.S. Pat. No. 2,298,744 to Liermann which requires the holder to be inserted into the sash of a window frame. U.S. Pat. No. 5,087,012 to Doublet describes a holder for displaying a flag on a table.

Other patents have been issued for devices which hold objects to flat surfaces, specifically pens or pencils. U.S. Pat. No. 5,484,066 to Luisi describes a mountable object holder attached by adhesive to an automobile dashboard. U.S. Pat. No. D 419,192 to Huang describes a magnet memo clip and pen holder which attaches to a ferrous surface. U.S. Pat. No. D 442,638 to Roush describes a hook and loop pen holder and U.S. Pat. No. D 441,021 to Roush describes a magnetic pen holder.

Patents which describe attaching objects to surfaces by using magnetic or adhesive backing include U.S. Pat. No. 6,052,933 to Lytle for a picture framing system and U.S. Pat. No. 5,974,715 to Werner, et al, for an article for framing a visual work. U.S. Pat. No. 6,491,271 B1 was issued to Adams for a magnetic hook or clip. Patent Application Publication No. US 2002/0064412 A1 by Piech describes a miniature pen with a holder that has an adhesive mounting strip.

BRIEF SUMMARY OF THE INVENTION

The present invention is a holder used to display the smallest sized flags, banners or pennants on smooth and fabric coated surfaces for decorative purposes. It is a further objective of the present invention to provide a miniature flag holder that is easy to use, stable, durable and reliable. It is a further objective of the present invention to be made of one-piece molded (ABS) durable plastic material which is aesthetically pleasing and simple in appearance and which will last for years of use.

DETAILED DESCRIPTION OF THE INVENTION

A. Overview

Figure 1:
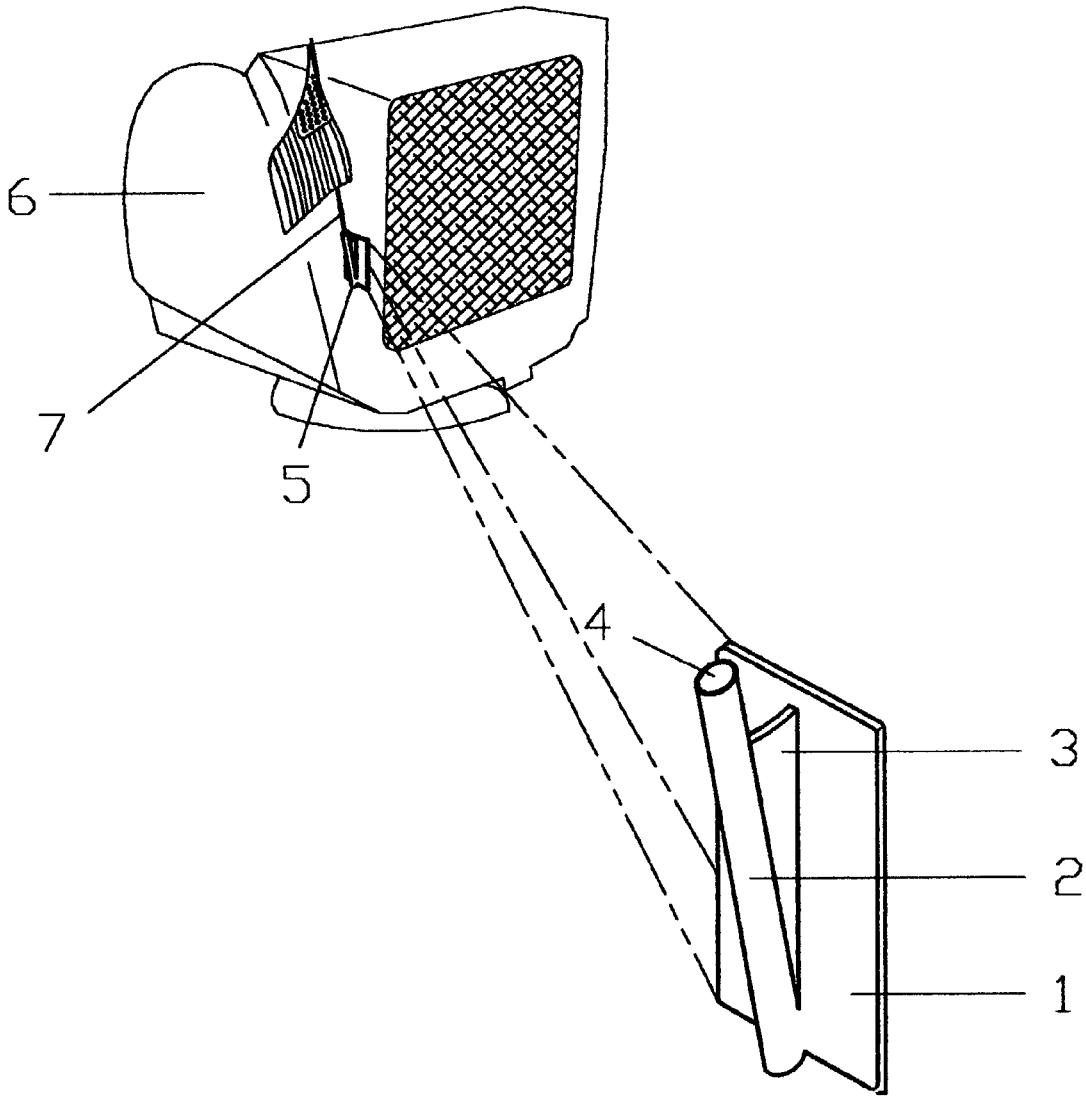
FIG. 1 is a 3-dimensional perspective view of the one-piece molded plastic miniature flag holder attached to a computer.

FIG. 1 illustrates a complete perspective 3-dimensional overall view of the miniature flag holder 5 as attached to a computer 6, displaying a small flag (shaft) 7. The flag, banner, or pennant displayed should be sized approximately 4 inches by 6 inches or smaller. The application of this flag holder can also be mounted vertically on smooth flat surfaces such as walls, ferrous surfaces such as refrigerators and file cabinets or fabric covered surfaces such as partitions used in offices. It depicts the vertical support surface plate 1, having a rectangular shape and being of one solid piece, with the flag shaft holding tube 2 attached by the support brace 3 to the face of the vertical support surface plate 1 of the miniature flag holder.

B. Structure

The miniature flag holder is tooled and died for a solid one-piece (ABS-Acrylonitrile Butadiene Styrene) plastic injection mold. There are many other types of materials that could be used which would generate the same form, fit and function, but not necessarily the same durability. The injection mold process uses raw plastic material which is heated in a chamber until it reaches its melting point. It is then injected into a mold where it is allowed to cool to become solid and then it is ejected from the mold.

Figure 2:
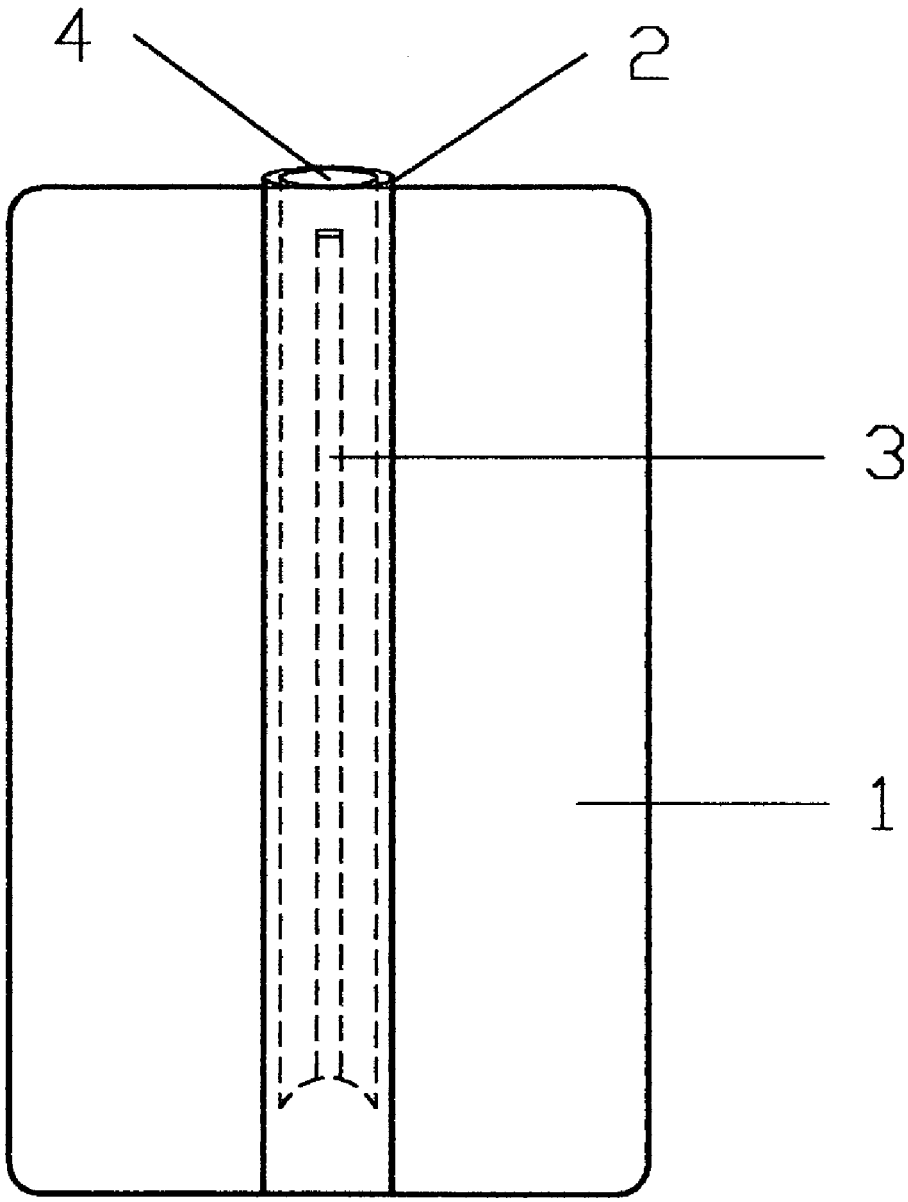
FIG. 2 is a front view showing the tube which holds the dowel shaft of a miniature flag, banner or pennant attached to the vertical support surface plate.

FIG. 2 illustrates a preferred embodiment of the front view of the miniature flag holder vertical support surface plate 1 having a rectangular shape and an opened 4 smooth-bored tube 2 to receive a flag (shaft) 7. It shows the bottom of the tube 2 attached flush to the edge of the bottom portion of the front of the vertical support surface plate 1.

Figure 3:
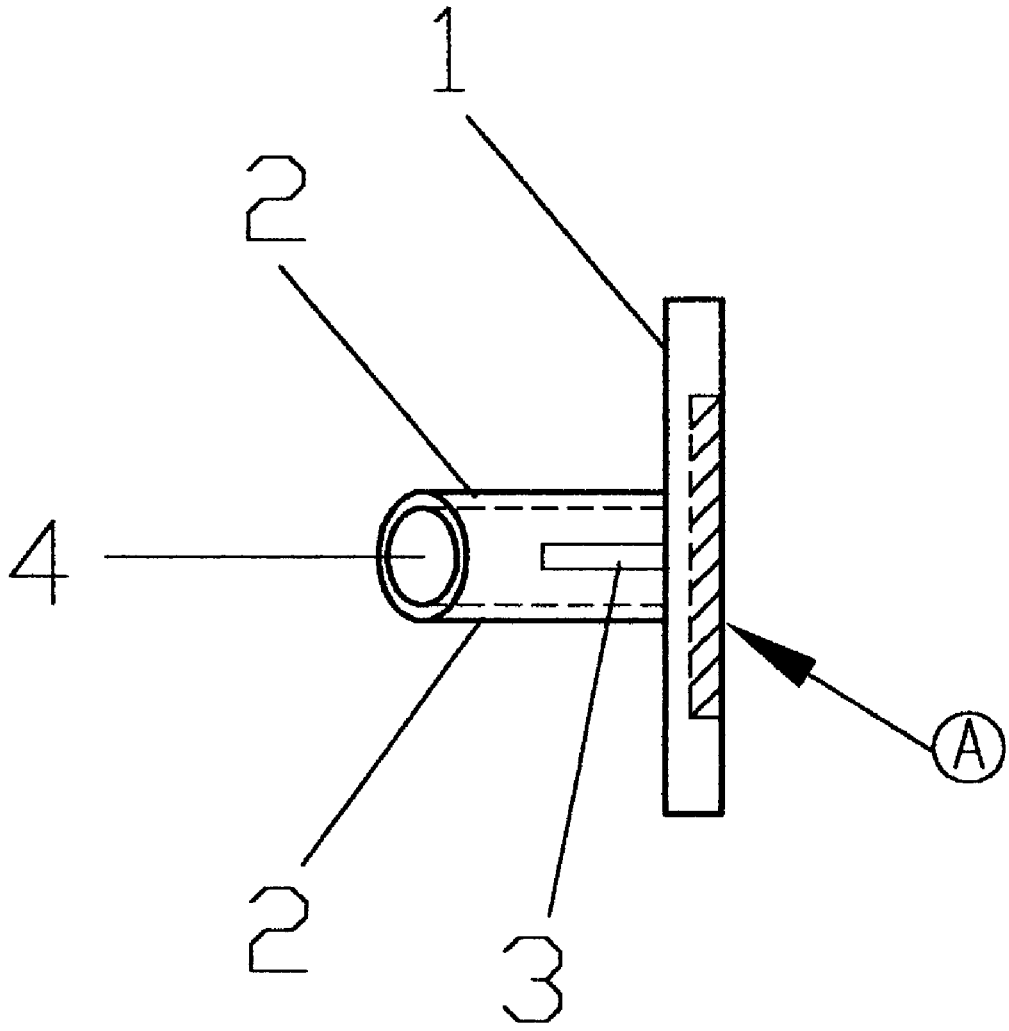
FIG. 3 is the top perspective view looking down upon the vertical support surface plate of the one-piece molded plastic miniature flag holder. It shows the flag shaft holding tube with its support brace. It also shows the slot for the double-sided adhesive mounting tape, magnet strip tape and/or VELCRO™ hook and loop fastening system to be attached to the back of the vertical support surface plate.

FIG. 3 illustrates a preferred embodiment of the top perspective view looking down upon the miniature flag holder. The view shows the flag holder with the opened 4 angled smooth-bored tube 2. It also shows the support brace 3 attached to the smooth-bored tube 2 and the vertical support surf ce plat 1. A shows the placement of a molded rectangular slot for insertion of double-sided adhesive mounting tape, adhesive backed magnetic strip, or VELCRO™ hook and loop fastening system.

Figure 4:
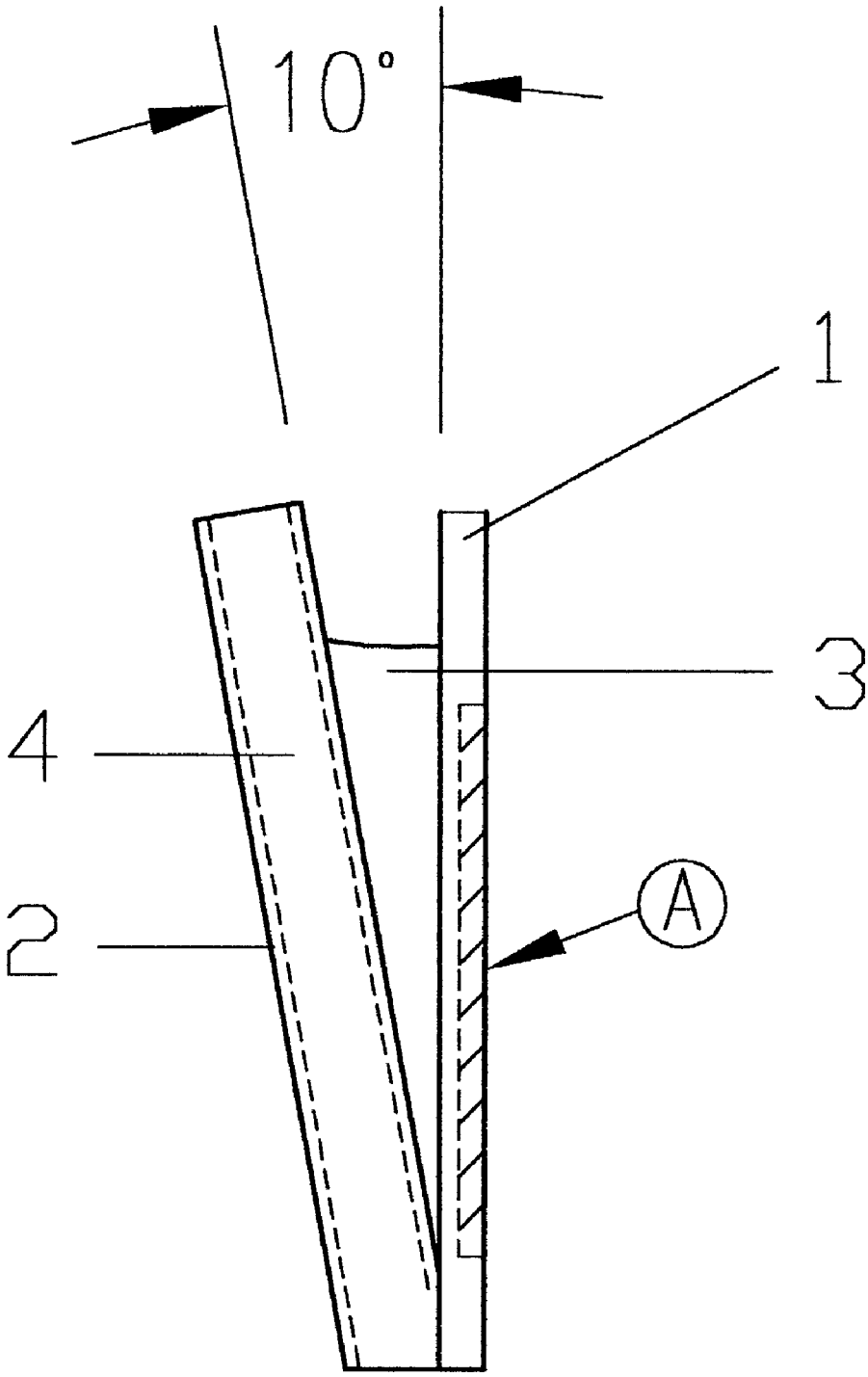
FIG. 4 is a side view of the one-piece molded plastic miniature flag holder showing the flag shaft tube holder and the support brace which attaches to the vertical support surface plate. It also shows the slot for the double-sided adhesive mounting tape, magnet strip tape and/or VELCRO™ hook and loop fastening system to be attached to the back of the vertical support surface plate.

FIG. 4 illustrates a preferred embodiment of the side view of the miniature flag holder. It shows the opened 4 angled smooth-bored tube 2, having uniform walls of solid construction, which receives the flag shaft. It illustrates the bottom of the tube 2 attached flush to the edge of the bottom portion of the front of the vertical support surface plate 1. It also illustrates the support brace 3 forming a bridge to connect the flag shaft holding tube 2 to the vertical support surface plate 1 at a ten (10) degree angle from the tube 2 to the front of the vertical support surface plate 1. It depicts the vertical support surface plate 1 being of one solid piece. A shows the placement of a molded rectangular slot for insertion of double-sided adhesive mounting tape, adhesive backed magnetic strip or VELCRO™ hook and loop fastening system. The vertical support surface plate 1 is to be approximately 1 and ¼ inches wide by 2 inches tall and ⅛ inch thick. The support brace 3 and shaft holding tube 2 is to be approximately 1/16 inch thick.

Figure 5:
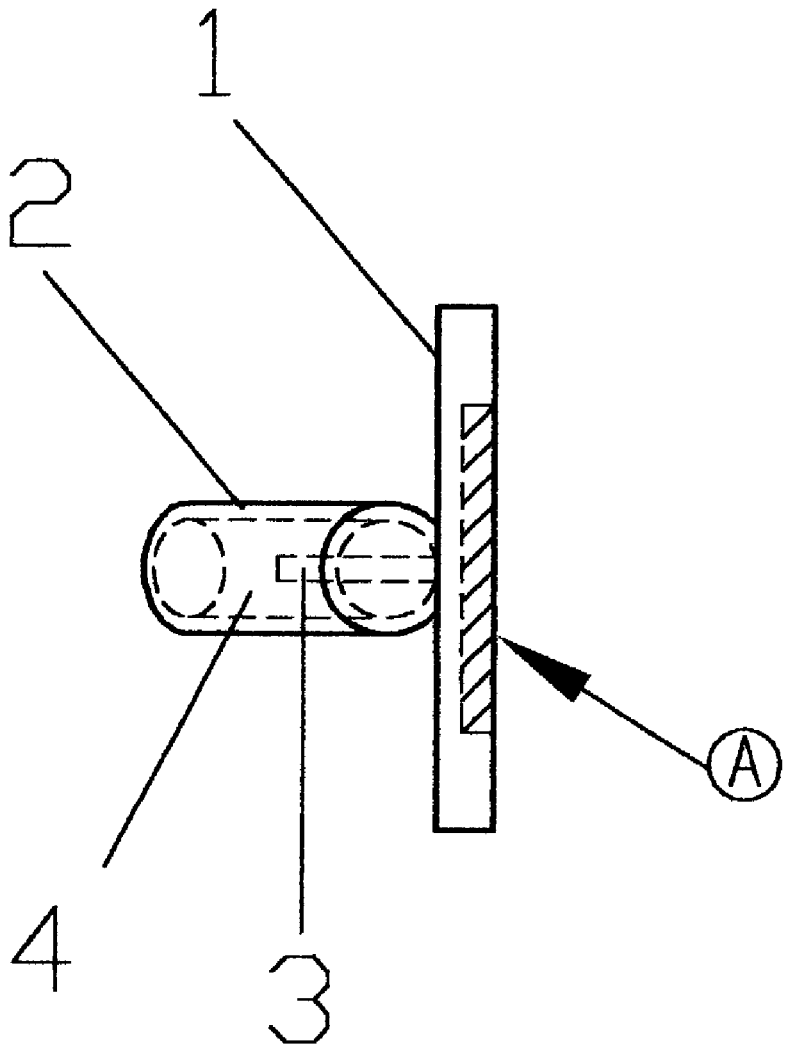
FIG. 5 is a bottom view of the one-piece molded plastic miniature flag holder showing the flag shaft tube holder and support brace which attaches to the vertical support surface plate. It also shows the slot for the double-sided adhesive mounting tape, magnet strip tape and/or VELCRO™ hook and loop fastening system to be attached to the back of the vertical support surface plate. It also shows the bottom of the smooth-bored tube to be a solid closed flat surface.

FIG. 5 illustrates a preferred embodiment of the bottom view of the miniature flag holder. The view shows the flag holder with the angled smooth-bored tube 2 for receiving a flag shaft. It also shows the support brace 3 attached to the smooth-bored tube 2 and the vertical support surface plate 1. It illustrates the bottom of the tube 2 attached flush to the edge of the bottom portion of the front of the vertical support surface plate 1. The bottom of the smooth-bored tube 2 is a solid closed flat surface. A shows the placement of a molded rectangular slot for insertion of double-sided adhesive mounting tape. adhesive backed magnetic strip or VELCRO™ hook and loop fastening system.

Figure 6:
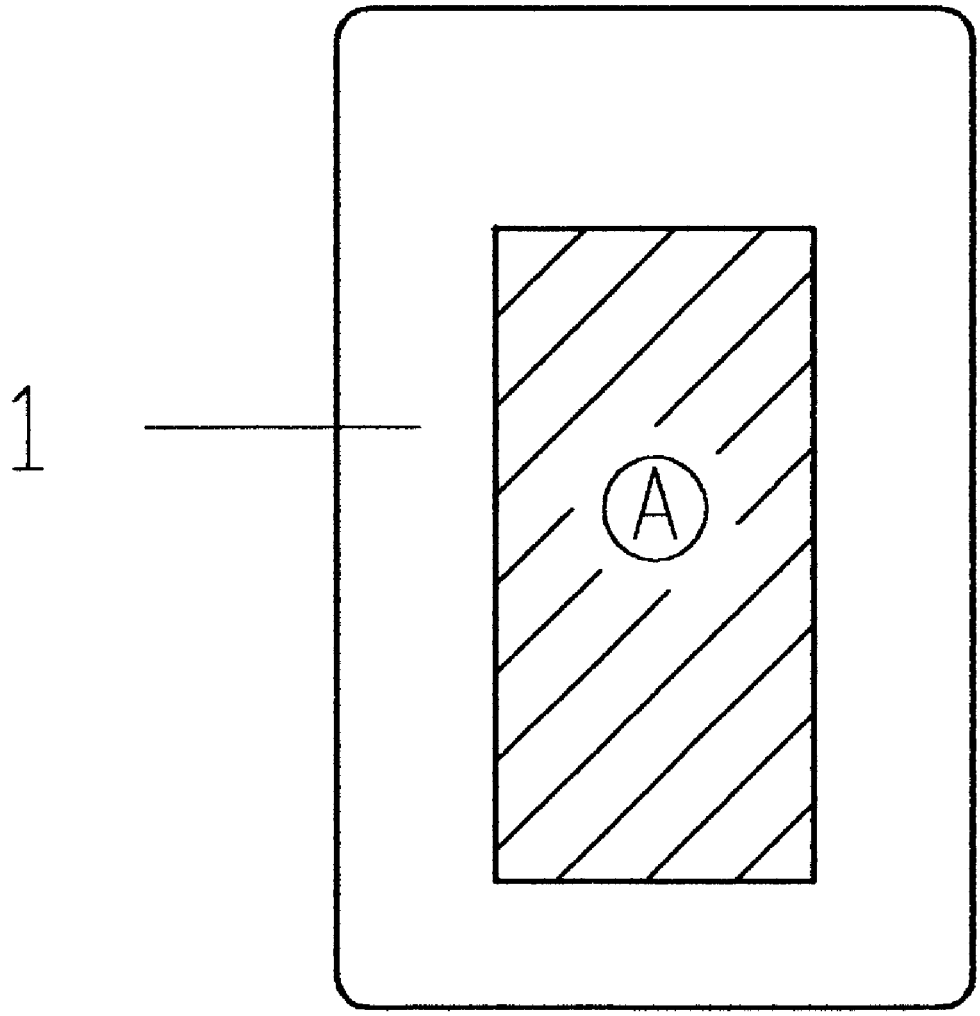
FIG. 6 is the perspective view of the back of the vertical support surface plate of the one-piece molded plastic miniature flag holder showing the slot for the double-sided adhesive mounting tape A for anchoring the flag holder to smooth surfaces, or magnet strip tape for anchoring the flag holder to ferrous surfaces, VELCRO™ hook and loop fastening system used for anchoring the flag holder to fabric covered surfaces.

FIG. 6 illustrates a preferred embodiment of the back view of the miniature flag holder. A shows the placement of a molded rectangular slot for insertion of double-sided adhesive mounting tape, adhesive backed magnetic strip or VELCRO™ hook and loop fastening system.

What is claimed, as being new and desired to be protected by Letters Patent of the United States is as follows:

1. A miniature flag holder for flags, banners or pennants sized approximately 4 inches by 6 inches or smaller intended to be mounted vertically on a flat surface, said holder comprising;

an integral molded plastic piece having a vertical support surface plate and a smooth bored tube extending at an angle from said plate, said tube having solid walls along its length defining an opening to receive a shaft of a flag, banner or pennant sized approximately 4 inches by 6 inches or smaller, a bottom of said tube having a solid closed flat surface, the bottom of said tube being attached flush to the edge of a bottom portion of a front of said vertical support surface plate, said vertical support surface plate having a rectangular shape, said plate being of one solid piece;

a support brace attached to said smooth-bored tube by which said tube projects at a ten (10) degree angle from said vertical support surface plate, said brace forming a bridge between the vertical support surface plate and the smooth-bored tube.

2. The miniature flag holder of according to claim 1, wherein the back of said vertical support surface plate further comprises one (1) molded rectangular slot to receive double-sided adhesive mounting tape whereby stability of placement on a smooth surface is achieved, or for placement of hook and loop fastening system whereby stability of placement on a fabric covered surface is achieved, or for placement of an adhesive backed magnetic strip whereby stability of placement on a ferrous surface is achieved.

* * * * *